US010895174B2

(12) United States Patent
Cecur

(10) Patent No.: US 10,895,174 B2
(45) Date of Patent: Jan. 19, 2021

(54) HEAVY DUTY VARIABLE VALVE ACTUATION

(71) Applicant: Eaton Intelligent Power Limited, Dublin (IE)

(72) Inventor: Majo Cecur, Rivarolo Canavese (IT)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/466,300

(22) PCT Filed: Dec. 5, 2017

(86) PCT No.: PCT/IB2017/057670
§ 371 (c)(1),
(2) Date: Jun. 4, 2019

(87) PCT Pub. No.: WO2018/104872
PCT Pub. Date: Jun. 14, 2018

(65) Prior Publication Data

US 2020/0072090 A1 Mar. 5, 2020

Related U.S. Application Data

(60) Provisional application No. 62/430,102, filed on Dec. 5, 2016.

(51) Int. Cl.
*F01L 1/18* (2006.01)
*F01L 1/26* (2006.01)
(Continued)

(52) U.S. Cl.
CPC ..... *F01L 1/18* (2013.01); *F01L 1/267* (2013.01); *F01L 13/06* (2013.01);
(Continued)

(58) Field of Classification Search
CPC ..... F01L 1/18; F01L 1/267; F01L 2305/00; F01L 13/06; F01L 2001/186;
(Continued)

(56) References Cited

U.S. PATENT DOCUMENTS 5,653,198 A 8/1997 Diggs
6,499,451 B1 12/2002 Hendriksma et al.
(Continued)

FOREIGN PATENT DOCUMENTS

EP 1927735 A1 6/2008
WO WO-2011064845 A1 * 6/2011 ..... F01L 1/26
WO WO 2015052930 A1 4/2015

*Primary Examiner* — Patrick Hamo
*Assistant Examiner* — Wesley G Harris
(74) *Attorney, Agent, or Firm* — Leydig, Voit & Mayer, Ltd.

(57) ABSTRACT

A valvetrain assembly includes: a main exhaust rocker arm assembly having a first main exhaust rocker arm and a second main exhaust rocker arm; a first latch assembly that selectively moves between a first position in which the first and second main exhaust rocker arms are locked for concurrent rotation and a second position in which one of the first and second main exhaust rocker arms rotates relative to an other of the first and second main exhaust rocker arms; a secondary exhaust rocker arm assembly having a first secondary exhaust rocker arm and a second secondary exhaust rocker arm; a second latch assembly that selectively moves between a first position in which the first and second secondary exhaust rocker arms are locked for concurrent rotation and a second position in which one of the first and second secondary exhaust rocker arms rotates.

20 Claims, 13 Drawing Sheets

(51) Int. Cl.
*F01L 13/06* (2006.01)
*F01L 1/46* (2006.01)

(52) U.S. Cl.
CPC ... *F01L 2001/186* (2013.01); *F01L 2001/467* (2013.01); *F01L 2305/00* (2020.05); *F01L 2800/19* (2013.01)

(58) Field of Classification Search
CPC ..... F01L 2001/467; F01L 2800/19; F01L 2800/00; F01L 13/00; F01L 13/0015; F01L 13/0036; F01L 1/185; F01L 13/0005
USPC ..... 123/90.16, 90.15, 90.39
See application file for complete search history.

(56) References Cited

U.S. PATENT DOCUMENTS

| | | | | |
|---|---|---|---|---|
| 8,468,988 | B2 * | 6/2013 | Nishikiori | B60K 6/445 123/90.16 |
| 10,550,739 | B2 * | 2/2020 | Raimondi | F01L 1/34 |
| 2008/0121477 | A1 * | 5/2008 | Bianchi | F01L 13/0026 188/273 |
| 2011/0214636 | A1 * | 9/2011 | Sunada | F01L 13/0036 123/90.44 |
| 2012/0016565 | A1 * | 1/2012 | Ide | F01L 1/3442 701/102 |
| 2014/0251266 | A1 | 9/2014 | Emmons et al. | |
| 2018/0363518 | A1 * | 12/2018 | Raimondi | F01L 1/047 |
| 2019/0063268 | A1 * | 2/2019 | Buonocore | F01L 1/185 |

* cited by examiner

| | Main INTAKE | Main EXHAUST | Secondary INTAKE | Secondary EXHAUST |
|---|---|---|---|---|
| EIVC | OCV OFF | OCV ON or OFF | 0 | 0 |
| LIVC | OCV ON | OCV ON or OFF | 0 | 0 |
| STD EX | OCV ON or OFF | OCV OFF | 0 | 0 |
| EEVO | OCV ON or OFF | OCV ON | 0 | 0 |
| TS EB | 0 | 0 | X | X |
| CDA | 0 | 0 | 0 | 0 |

HEAVY DUTY VARIABLE VALVE ACTUATION

CROSS-REFERENCE TO RELATED APPLICATIONS

This application is a U.S. National Phase application under 35 U.S.C. § 371 of International Application No. PCT/IB2017/057670, filed on Dec. 5, 2017, and claims benefit to U.S. Provisional Patent Application No. U.S. 62/430,102, filed on Dec. 5, 2016. The International Application was published in English on Jun. 14, 2018 as WO 2018/104872 under PCT Article 21(2).

FIELD

The present disclosure relates generally to variable valve actuation systems.

BACKGROUND

Combustion cycles on four-stroke internal combustion engines can be modified to achieve various desired results such as improved fuel economy. In one method, the expansion stroke is increased relative to the compression stroke. The effect is sometimes referred to as a Miller Cycle or as an Atkinson Cycle. The Miller and Atkinson Cycles can be achieved by either closing the intake valve earlier than a normal or Otto Cycle ("Base") with a shorter than normal intake valve lift duration ("EIVC"), or by closing the intake valve later by a longer than normal intake valve lift profile ("LIVC").

Various systems have been developed for altering the valve-lift characteristics for internal combustion engines. Such systems, commonly known as variable valve lift (WL), variable valve timing (VVT), or variable valve actuation (WA), improve fuel economy, reduce emissions and improve drive comfort over a range of speeds.

Discrete variable valve lift can be obtained through the use of switching rocker arm technology. Switching rocker arms allow for control of valve actuation by alternating between latched and unlatched states, usually involving an inner arm and an outer arm. In some circumstances, these arms engage different cam lobes, such as low-lift lobes, high-lift lobes, and no-lift lobes. Mechanisms are required for switching rocker arm modes in a manner suited for operation of internal combustion engines.

Compression engine brakes can be used as auxiliary brakes, in addition to wheel brakes, on relatively large vehicles, for example trucks, powered by heavy or medium duty diesel engines. A compression engine braking system is arranged, when activated, to provide an additional opening of an engine cylinder's exhaust valve when the piston in that cylinder is near a top-dead-center position of its compression stroke so that compressed air can be released through the exhaust valve. This causes the engine to function as a power consuming air compressor which slows the vehicle.

In a typical valve train assembly used with a compression engine brake, the exhaust valve is actuated by a rocker arm which engages the exhaust valve by means of a valve bridge. The rocker arm rocks in response to a cam on a rotating cam shaft and presses down on the exhaust valve to open it. In some examples a valve bridge may be provided between the rocker arm and a pair of exhaust valves. A hydraulic lash adjuster may also be provided in the valve train assembly to remove any lash or gap that develops between the components in the valve train assembly.

The background description provided herein is for the purpose of generally presenting context of the disclosure. Work by the presently named inventor, to the extent it is described in this background section, as well as aspects of the description that may not otherwise qualify as prior art at the time of filing, are neither expressly nor impliedly admitted as prior art against the present disclosure.

SUMMARY

In an embodiment, the present invention provides a valvetrain assembly, comprising: a main exhaust rocker arm assembly having a first main exhaust rocker arm and a second main exhaust rocker arm; a first latch assembly configured to selectively move between a first position wherein the first and second main exhaust rocker arms are locked for concurrent rotation and a second position wherein one of the first and second main exhaust rocker arms is configured to rotate relative to an other of the first and second main exhaust rocker arms; a secondary exhaust rocker arm assembly having a first secondary exhaust rocker arm and a second secondary exhaust rocker arm; a second latch assembly configured to selectively move between a first position wherein the first and second secondary exhaust rocker arms are locked for concurrent rotation and a second position wherein one of the first and second secondary exhaust rocker arms is configured to rotate relative to an other of the first and second secondary exhaust rocker arms; and an actuation assembly configured to selectively move the first and second latch assemblies between the respective first and second positions, the actuation assembly comprising: an actuator configured to rotate an exhaust cam rod that includes a first cam and a second cam thereon; a main arm configured to rotate based upon movement of the first cam causing the first latch assembly to move from the first position to the second position; and a secondary arm configured to rotate based upon movement of the second cam causing the second latch assembly to move from the first position to the second position.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
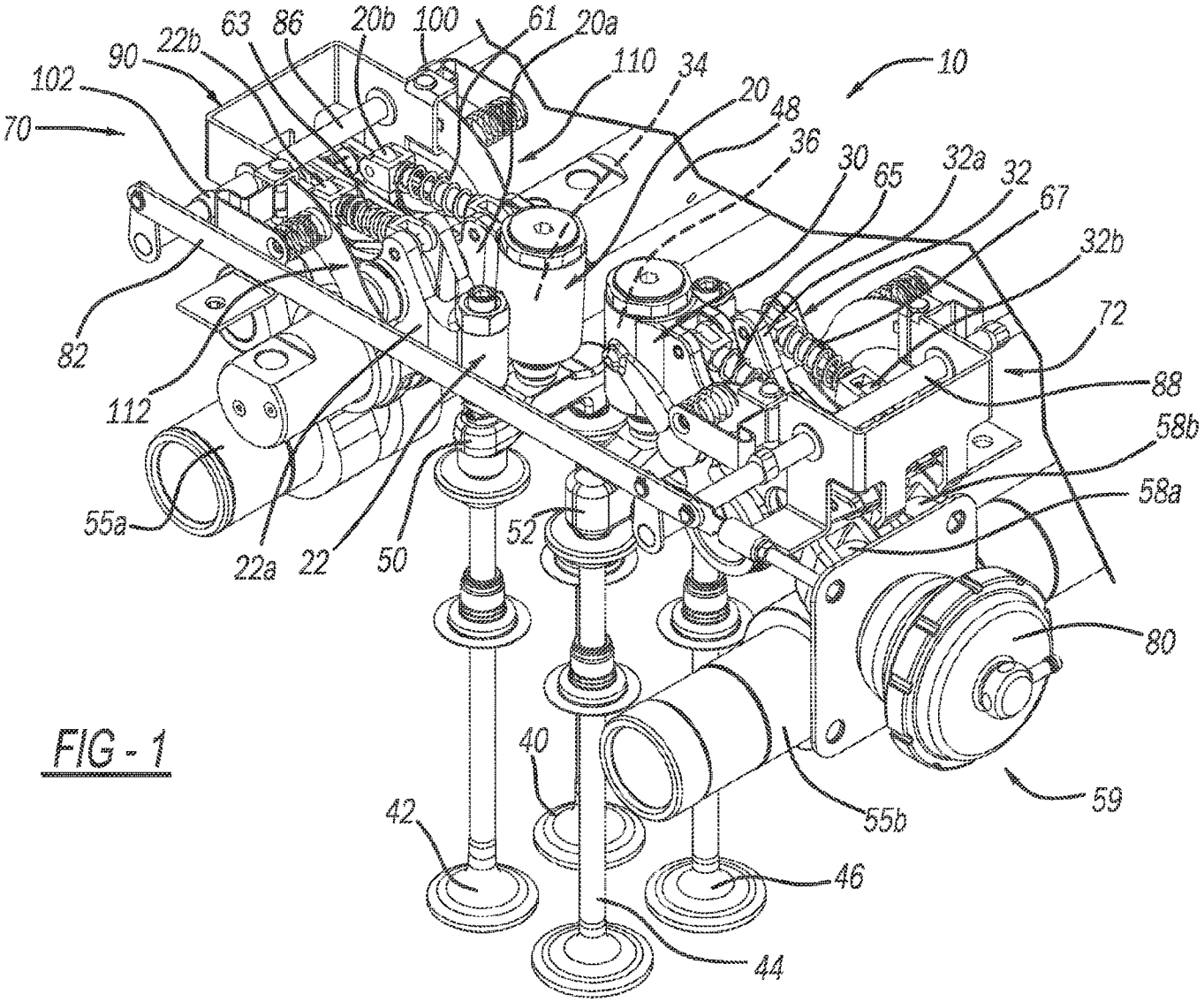
FIG. 1 is a first perspective view of a partial valvetrain assembly incorporating two exhaust rocker arm assemblies configured for opening and closing respective exhaust valves and two intake rocker arm assemblies for opening and closing respective intake valves according to one example of the present disclosure.

A valvetrain assembly constructed in accordance to one example of the present disclosure includes a main and secondary exhaust rocker arm assembly, a first and second latch assembly and an actuation assembly. The main exhaust rocker arm assembly has a first main exhaust rocker arm and a second main exhaust rocker arm. The first latch assembly selectively moves between a first position wherein the first and second main exhaust rocker arms are locked for concurrent rotation and a second position wherein one of the first and second main exhaust rocker arms rotates relative to the other of the first and second main exhaust rocker arms. The secondary exhaust rocker arm assembly has a first secondary exhaust rocker arm and a secondary exhaust rocker arm. The second latch assembly selectively moves between a first position wherein the first and second secondary exhaust rocker arms are locked for concurrent rotation and a second position wherein one of the first and second secondary exhaust rocker arms rotates relative to the other of the first and second secondary exhaust rocker arms. The actuation assembly selectively moves the first and second latch assemblies between the respective first and second positions. The actuation assembly has an actuator, a main arm and a secondary arm. The actuator rotates an exhaust cam rod that includes a first cam and a second cam. The main arm rotates based upon movement to the first cam causing the first latch assembly to move from the first position to the second position. The secondary arm rotates based upon movement of the second cam causing the second latch assembly to move from the first position to the second position.

According to additional features, the actuation assembly further includes a link arm disposed between the actuator and the exhaust cam rod wherein translation of the link arm causes rotation of the exhaust cam rod. The first latch assembly comprises an inner pin and an outer pin slidably disposed in the main exhaust rocker arm assembly. When the first latch assembly is in the first position, the inner and outer pins are out of alignment with the corresponding first and second main exhaust rocker arms and when the second latch assembly is in the second position, the inner and outer pins are in alignment with the corresponding first and second main exhaust rocker arms.

The second latch assembly comprises an inner pin and an outer pin slidably disposed in the main exhaust rocker arm assembly. When the second latch assembly is in the first position, the inner and outer pins are out of alignment with the corresponding first and second secondary exhaust rocker arms and when the second latch assembly is in the second position, the inner and outer pins are in alignment with the corresponding first and second secondary exhaust rocker arms. The main arm comprises a first main swing arm and a second main swing arm that are coupled by a main biasing member. The main biasing member urges the first main swing arm into engagement with the first cam.

According to other features, a first leaf spring urges the first latch assembly to return to the first position. A second leaf spring urges the second latch assembly to return to the first position. The secondary arm comprises a first secondary swing arm and a second secondary swing arm that are coupled by a second biasing member. The secondary biasing member urges the first secondary swing arm into engagement with the second cam.

In other features, the valvetrain assembly further includes a main intake rocker arm assembly, a third latch assembly, a secondary intake rocker arm assembly and a fourth latch assembly. The main intake rocker arm assembly has a first main intake rocker arm and a second main intake rocker arm. The third latch assembly selectively moves between a first position wherein the first and second main intake rocker arms are locked for concurrent rotation and a second position wherein one of the first and second main intake rocker arms rotates relative to the other of the first and second main intake rocker arms. The secondary intake rocker arm assembly has a first secondary intake rocker arm and a second secondary intake rocker arm. The fourth latch assembly selectively moves between a first position wherein the first and second secondary intake rocker arms are locked for concurrent rotation and a second position wherein one of the first and second secondary intake rocker arms rotates relative to the other of the first and second secondary intake rocker arms. The actuation assembly further comprises an intake cam rod. The actuator concurrently rotates the exhaust and intake cam rods.

In additional features, the main exhaust rocker arm assembly is configured to selectively operate in standard exhaust lift and early exhaust valve opening (EEVO). The main intake rocker arm assembly is configured to selectively operate in early intake valve closing (EIVC) and late intake valve closing (LIVC). The secondary exhaust rocker arm assembly and the secondary intake rocker arm assembly are configured to selectively operate in two-strike engine brake (TSEB). The first main exhaust rocker arm has a rocker arm body that defines an oil supply channel and an opening that receives the exhaust rocker shaft.

According to additional features, the first main exhaust rocker arm further comprises a first capsule assembly disposed on the rocker arm body and configured to selectively communicate oil to and from the oil supply channel. The capsule assembly comprises a plunger assembly and a shuttle assembly. The plunger assembly has a plunger that selectively translates within a plunger chamber between an extended rigid position based upon the plunger chamber being pressurized with oil and a retracted non-rigid position based upon the plunger chamber being depressurized, the plunger moving the engine valve toward an open position. The shuttle assembly moves between a first position and a second position based upon oil communicated in the oil supply channel. The shuttle assembly has a shuttle valve that selectively moves between a closed position and an open position wherein in the open position oil flows into the plunger chamber. the rocker arm assembly sequentially moves along a (i) a first valve lift profile wherein pressurized oil is communicated from the oil supply channel, the shuttle assembly moving into the second position causing the shuttle valve to be opened, the pressure chamber to be pressurized and the plunger to move to the extended rigid position, (ii) a reset valve lift profile wherein pressurized oil is not communicated from the oil supply channel, the shuttle assembly moving into the first position, and (iii) a valve closing profile.

In additional features, the shuttle assembly moves into the second position based on the oil supply channel of the rocker arm body being aligned with an actuation oil supply channel on the exhaust rocker shaft. The shuttle assembly moves into the first position based on the oil supply channel of the rocker arm body being aligned with a reset discharge channel on the rocker shaft. The actuator can be a pneumatic actuator.

Heavy duty vehicles are required to be 2.5% more fuel efficient annually between 2021 and 2027. The present disclosure provides implementations and strategies for achieving more fuel efficient valve actuation. As will become appreciated from the following discussion, the present disclosure provides a heavy duty variable valvetrain 10 that provides LIVC, EIVC, standard exhaust valve opening, early exhaust valve opening (EEVO), two stroke engine braking (TSEB) and cylinder deactivation (CDA) in one system.

The heavy duty variable valvetrain 10 is a dual overhead cam valvetrain layout based on four rocker arm assemblies for each cylinder. In the particular example discussed herein, a partial valvetrain assembly is shown that utilizes engine braking configured for use in a three-cylinder bank portion of a six-cylinder engine. It will be appreciated however that the present teachings are not so limited. In this regard, the present disclosure may be used in any valvetrain assembly that that utilizes variable valve actuation. The partial valvetrain assembly 10 shown in the drawings provides four rocker arm assemblies per cylinder. For simplicity, the following discussion is focused on operation of these four rocker arm assemblies configured for use on a single cylinder. It will be appreciated that four rocker arm assemblies are further provided for each of the remaining cylinders.

The valvetrain 10 includes a main exhaust rocker arm assembly 20, a secondary exhaust rocker arm assembly 22, a main intake rocker arm assembly 30 and a secondary intake rocker arm assembly 32. The main exhaust rocker arm assembly 20 and the main intake rocker arm assembly 30 incorporate a reset function capsule 34 and 36, respectively. The secondary exhaust rocker arm assembly 22 and the secondary intake rocker arm assembly 32 are configured for selective operation in a two-stroke engine brake mode.

Each of the rocker arm assemblies 20, 22, 30 and 32 incorporate a deactivating scissor configuration. Explained further, the main exhaust rocker arm assembly 20 collectively includes a first main exhaust rocker arm 20*a* and a second main exhaust rocker arm 20*b*. The secondary exhaust rocker arm assembly 22 collectively includes a first secondary exhaust rocker arm 22*a* and a second secondary exhaust rocker arm 22*b*. The main intake rocker arm assembly 30 collectively includes a first main intake rocker arm 30*a* and a second main intake rocker arm 30*b*. The secondary intake rocker arm assembly 32 collectively includes a first secondary intake rocker arm 32*a* and a second secondary intake rocker arm 32*b*.

Exhaust valves 40, 42 are opened and closed by the main exhaust rocker arm assembly 20 and the secondary exhaust rocker arm assembly 22. Similarly, intake valves 44, 46 are opened and closed by the main intake rocker arm assembly 30 and the secondary intake rocker arm assembly 32. An intake rocker shaft (removed for clarity) is received by the valve train carrier and supports rotation of the main and secondary intake rocker arm assemblies 30, 32. An exhaust rocker shaft 48 is received by the valve train carrier and supports rotation of the main and secondary exhaust rocker arm assembles 20, 22. In the example shown, the main exhaust rocker arm assembly 20 opens and closes exhaust valves 40, 42 through a valve bridge 50. The main intake rocker arm assembly 30 opens and closes intake valves 44, 46 through a valve bridge 52. The secondary exhaust rocker arm assembly 22 can selectively open the exhaust valve 42 during two-stroke engine braking. The secondary intake rocker arm assembly 32 can selectively open the intake valve 46 during two-stroke engine braking. The exhaust valves 40, 42 and the intake valves 44, 46 are biased closed by valve springs (removed for clarity).

Figure 2:
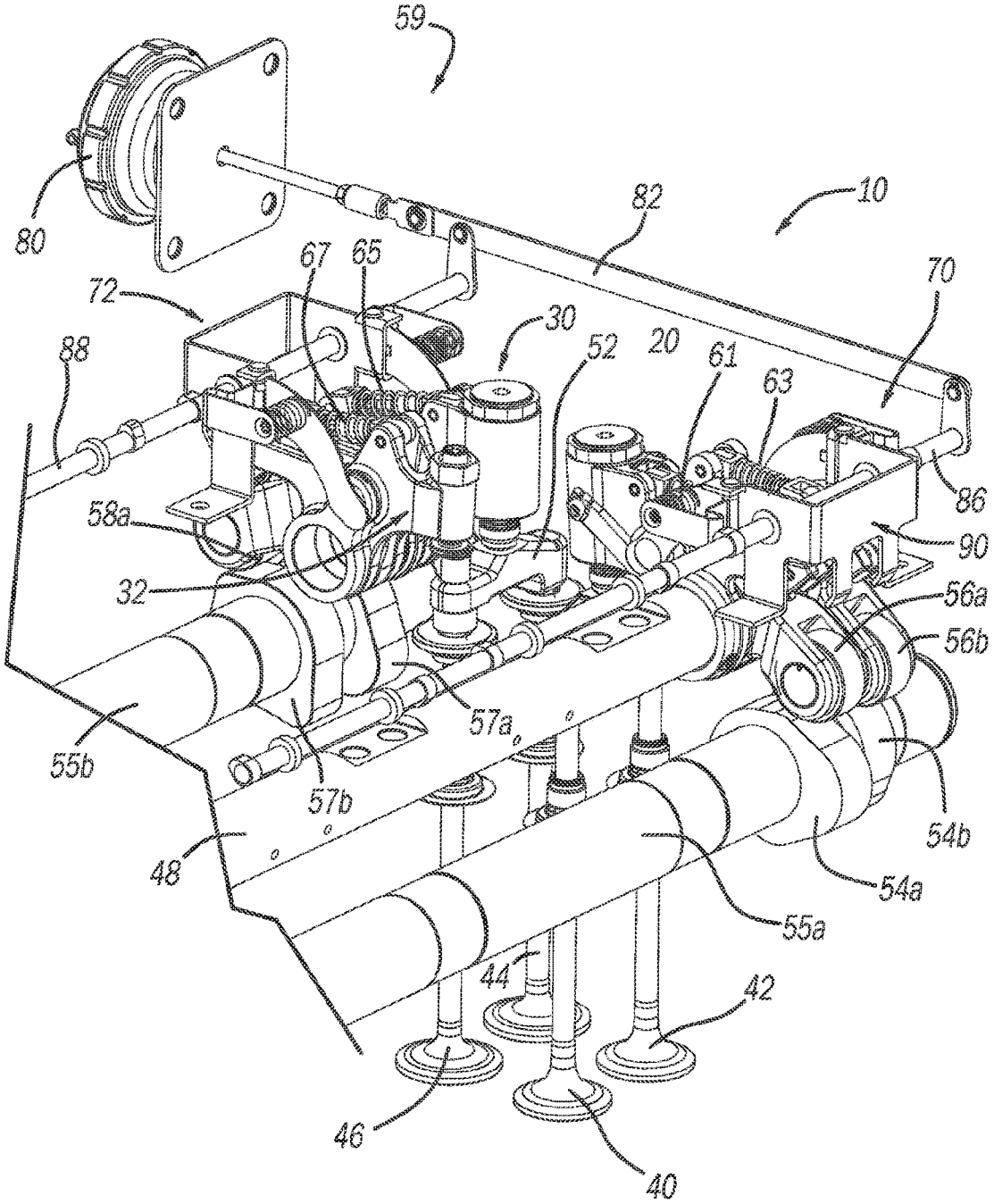
FIG. 2 is a second perspective view of the partial valvetrain assembly shown in FIG. 1.

The main exhaust rocker arm assembly 20 rotates around the exhaust rocker shaft 48 based on a lift profile of a main exhaust cam 54*a* (FIG. 2) that rotates with an exhaust camshaft 55*a*. The secondary exhaust rocker arm assembly 22 rotates around the exhaust rocker shaft 48 based on a lift profile of a secondary exhaust cam 54*b* that rotates with the exhaust camshaft 55*a*. The main exhaust rocker arm assembly 20 has a roller 56*a* that rotatably engages the main exhaust cam 54*a*. The secondary exhaust rocker arm assembly 22 has a roller 56*b* that rotatably engages the secondary exhaust cam 54*b*. The main intake rocker arm assembly 30 rotates around the intake rocker shaft based on a lift profile of a main intake cam 57*a* that rotates with an intake camshaft 55*b*. The secondary intake rocker arm assembly 32 rotates around the intake rocker shaft based on a lift profile of a secondary intake cam 57*b* that rotates with the intake camshaft 55*b*. The main intake rocker arm assembly 30 has a roller 58*a* (FIG. 1) that rotatably engages the main intake cam 57*a* (FIG. 2). The secondary intake rocker arm assembly 32 has a roller 57*b* that rotatably engages the secondary intake cam 57*b*.

Figure 3:
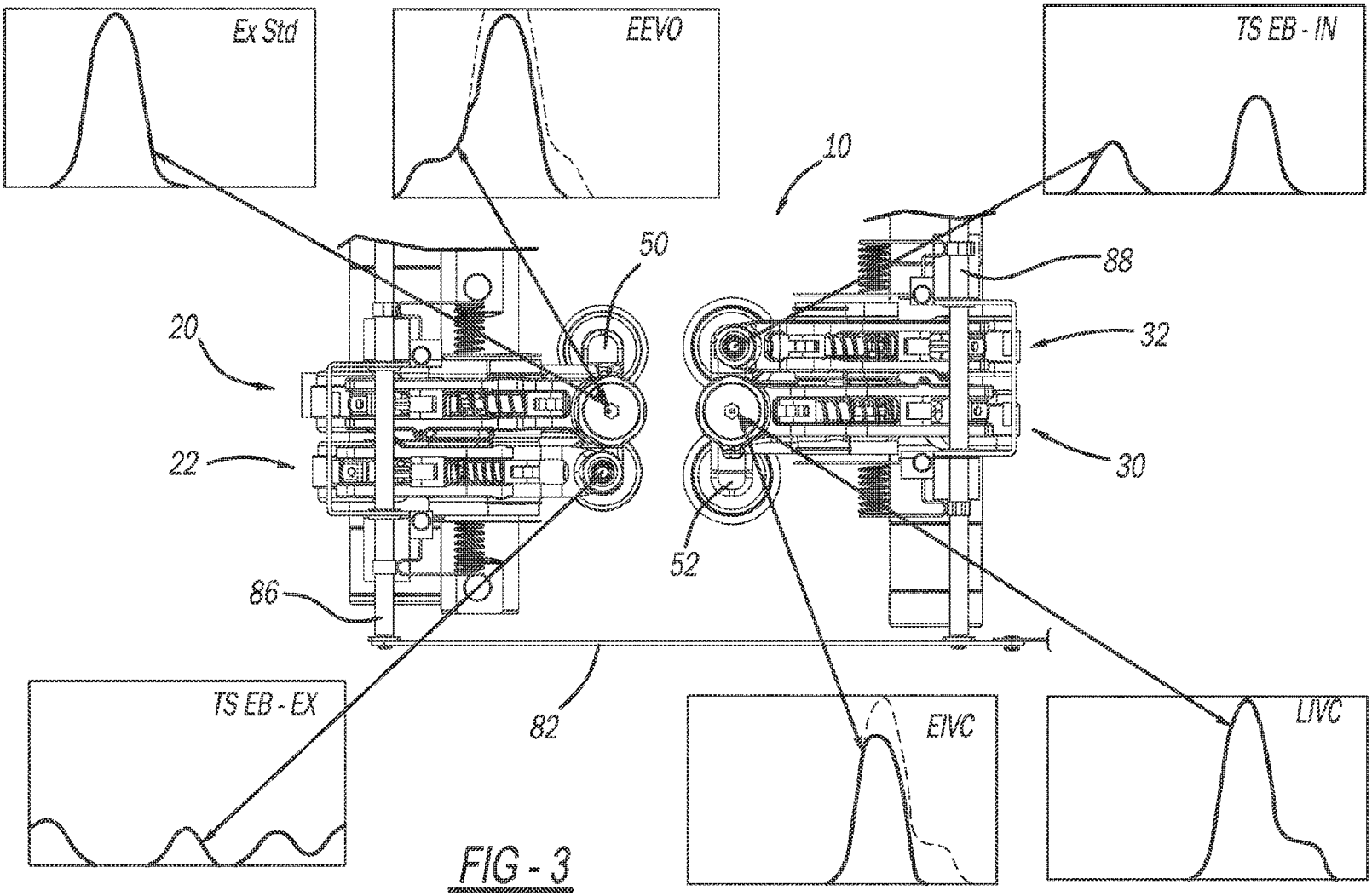
FIG. 3 is a plan view of the partial valvetrain assembly of FIG. 1 and shown with exemplary exhaust and intake lift profiles achievable with the exhaust and intake rocker arm assemblies including standard exhaust lift profile, early exhaust valve opening (EEVO) profile, two stroke engine braking (TSEB), early intake valve closing (EIVC) and late intake valve closing (LIVC)
Figures 4, 5:
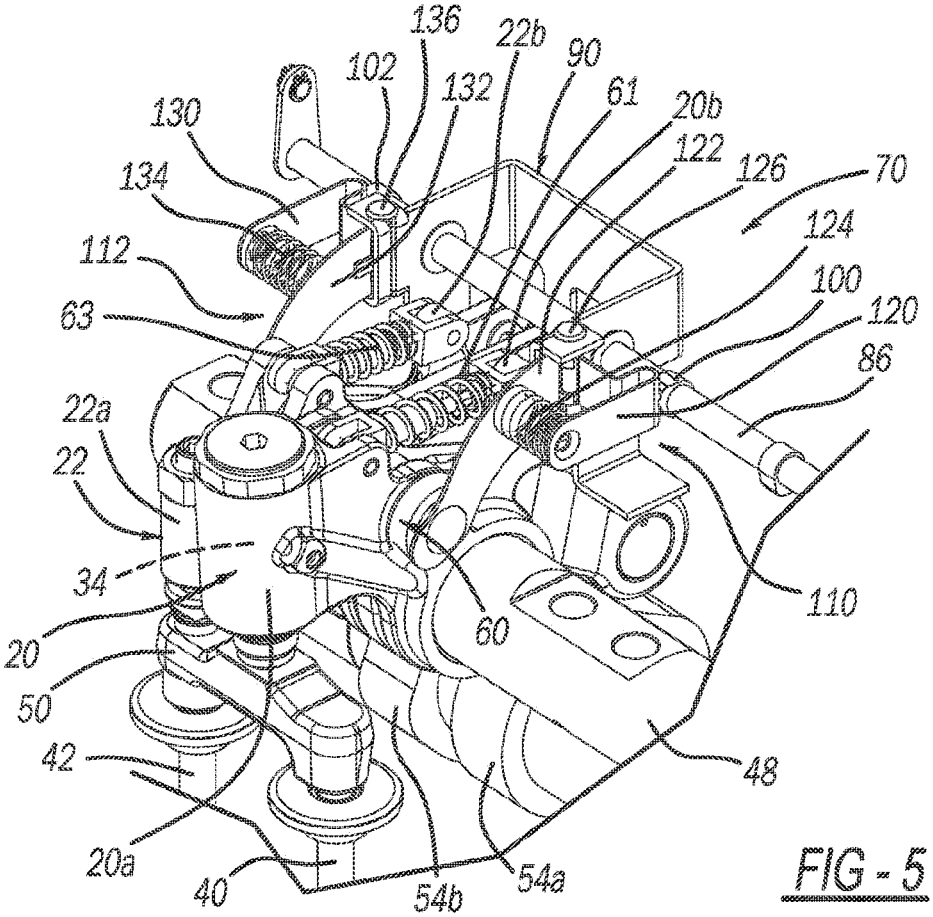
FIG. 4 is a table illustrating operating modes available for the valvetrain assembly of the present disclosure.
FIG. 5 is a perspective detail view of the main and secondary exhaust rocker arm assemblies shown with an exhaust side deactivation assembly constructed in accordance to one example of the present disclosure.
Figure 6:
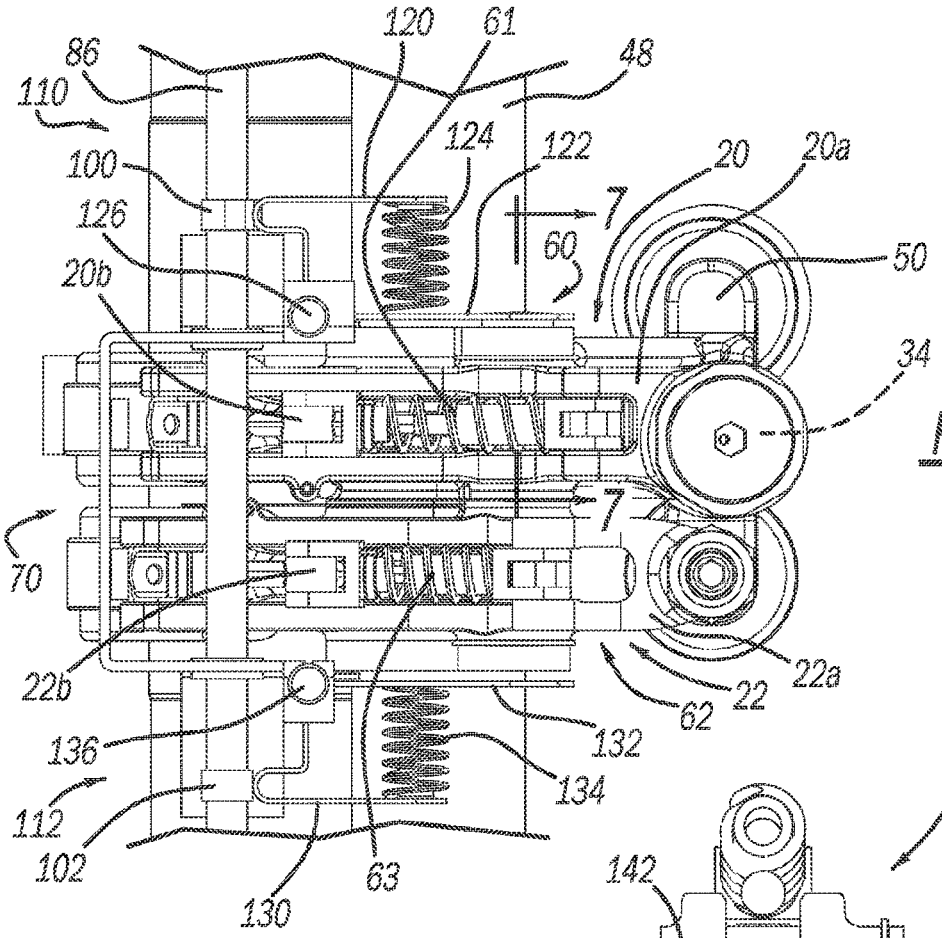
FIG. 6 is a plan view of the main and secondary exhaust rocker arm assemblies and exhaust side deactivation assembly of FIG. 5 shown with the main exhaust latch actuation assembly in a deactivated position.

As will become appreciated from the following discussion and as shown in FIGS. 3 and 4, the main exhaust rocker arm assembly 20 can be configured for operation along a standard exhaust valve lift profile or an early exhaust valve lift profile. The secondary exhaust rocker arm assembly 22 can be configured for operation in a two-stroke engine braking exhaust profile. The main intake rocker arm assembly 30 can be configured for operation along an early intake valve closing (EIVC) lift profile or a late intake valve closing profile (LIVC). The secondary intake rocker arm assembly 32 can be configured for operation in a two-stroke engine braking intake profile. As discussed herein with respect to FIGS. 12-16, the main exhaust rocker arm assembly 20 and main intake rocker arm assembly 30 are actuated based on pressurized oil (two oil control valves). When the main exhaust rocker arm assembly 20 is operating in EEVO, the (first) oil control valve (exhaust side) is positioned upstream to direct oil flow into the capsule 34. The (second) oil control valve (intake side) however is positioned downstream of the capsule 36 to control oil discharge from the capsule 36. Deactivation for two-stroke engine brake and cylinder deactivation is accomplished with an electromechanical actuation assembly 59.

Each rocker arm pairs 20*a*, 20*b*; 22*a*, 22*b*; 30*a*, 30*b*; and 32*a*, 32*b* have a latch assembly 60, 62, 64 and 66 that independently moves based on the electromechanical actuation assembly 59 to allow concurrent rotation of each rocker arm pair, or relative rotation of the second rocker arm from the first rocker arm. Explained more clearly, a latch assembly 60 moves between a first position (FIG. 7) to allow concurrent rotation of the rocker arm pairs 20*a* and 20*b* and a second position (FIG. 9) to allow rotation of the second main exhaust rocker arm 20*b* relative to the first main exhaust rocker arm 20*a*. As referenced in FIGS. 6-9, the latch assembly 60 is shown in a first position (FIG. 7) to allow concurrent rotation of the rocker arm pairs 20*a* and 20*b* and a second position (FIG. 9) to allow rotation of the second main exhaust rocker arm 20*b* relative to the first main exhaust rocker arm 20*a* (lost motion stroke resulting in no valve actuation). It will be appreciated that each of the other latch assembly 60, 62 and 66 operate similarly.

The latch assembly 62 moves between a first position to allow concurrent rotation of the rocker arm pairs 22*a* and 22*b* and a second position to allow rotation of the second secondary exhaust rocker arm 22*b* relative to the first secondary exhaust rocker arm 22*a* (lost motion stroke resulting in no valve actuation). The latch assembly 64 moves between a first position to allow concurrent rotation of the rocker arm pairs 30*a* and 30*b* and a second position to allow rotation of the second main intake rocker arm 30*b* relative to the first main intake rocker arm 30*a* (lost motion stroke resulting in no valve actuation). The latch assembly 66 moves between a first position to allow concurrent rotation of the rocker arm pairs 32*a* and 32*b* and a second position to allow rotation of the second secondary intake rocker arm 32*b* relative to the first secondary intake rocker arm 32*a* (lost motion stroke resulting in no valve actuation).

The first main exhaust rocker arm 20*a* and the second main exhaust rocker arm 20*b* can rotate together when a main exhaust latch assembly 60 is in a normally latched position. The second main exhaust rocker arm 20*b* can rotate relative to the first main exhaust rocker arm 20*a* when the main exhaust latch assembly 60 is in an unlatched position. A coil return spring 61 biases the second main exhaust rocker arm 20*b* back against the main exhaust cam 54*a*. The first secondary exhaust rocker arm 22*a* and the second secondary exhaust rocker arm 22*b* can rotate together when a secondary exhaust latch assembly 62 is in a normally latched position. The second secondary exhaust rocker arm 22*b* can rotate relative to the first secondary exhaust rocker arm 22*a* when the secondary exhaust latch assembly 62 is in an unlatched position. A coil return spring 63 biases the second secondary exhaust rocker arm 22*b* back against the secondary exhaust cam 54*b*.

The first main intake rocker arm 30*a* and the second main intake rocker arm 30*b* can rotate together when a main intake latch assembly 64 is in a normally latched position. The second main intake rocker arm 30*b* can rotate relative to the first main intake rocker arm 30*a* when the main intake latch assembly 64 is in an unlatched position. A coil return spring 65 biases the second main intake rocker arm 30*b* back against the main intake cam 57*a*. The first secondary intake rocker arm 32*a* and the second secondary intake rocker arm 32*b* can rotate together when a secondary intake latch assembly 66 is in a normally latched position. The second secondary intake rocker arm 32*b* can rotate relative to the first secondary intake rocker arm 32*a* when the secondary intake latch assembly 66 is in an unlatched position. A coil return spring 67 biases the second secondary intake rocker arm 32*b* back against the secondary intake cam 57*b*.

Returning now to FIGS. 1 and 2, the electromechanical actuation assembly 59 will be further described. The electromechanical actuation assembly 59 generally includes an exhaust side deactivation assembly 70 and an intake side deactivation assembly 72. In general, the electromechanical actuation assembly 59 includes a common pneumatic actuator 80 that translates a link arm 82. It will be appreciated that other actuators beyond pneumatic may be alternately used. For example the actuator may be electrohydraulic. Translation of the link arm 82 causes concurrent rotation of an exhaust side cam rod 86 and an intake side cam rod 88. The following description will be focused on the exhaust side deactivation assembly 70. It will be appreciated however that additional exhaust side deactivation assemblies are provided for each cylinder and operate similarly. Likewise, the intake side deactivation assembly 72, as well as other intake side deactivation assemblies on other cylinders operate similarly.

With particular reference now to FIG. 5, the exhaust side cam rod 86 extends through a bracket assembly 90 and includes a first cam 100 and a second cam 102. The exhaust side deactivation assembly 70 includes a main exhaust latch actuation assembly 110 and a secondary exhaust latch actuation assembly 112. The main exhaust latch actuation assembly 110 moves the main exhaust latch assembly between the latched position and the unlatched position. The secondary exhaust latch actuation assembly 112 moves the secondary exhaust latch assembly between the latched position and the unlatched position. The main exhaust latch actuation assembly 110 includes a first main swing arm 120, a second main swing arm 122, and a main biasing member 124. The first and second main swing arms 120, 122 are rotatably coupled about a pivot axle 126 arranged on the bracket assembly 90. The secondary exhaust latch assembly 112 includes a first secondary swing arm 130, a second secondary swing arm 132 and a secondary biasing member 134. The first and second secondary swing arms 130, 132 are rotatably coupled about a pivot axle 136 arranged on the bracket assembly 90. The biasing members 124, 134 influence constant engagement of the first main swing arm 120 and first secondary swing arm 130 with the respective cams 100 and 102.

With additional reference now to FIGS. 6-9, actuation of the main exhaust latch actuation assembly 110 will be described. Rotation of the exhaust side cam rod 86 causes the cam 100 to engage and therefore rotate the first main swing arm 120 around the pivot axle 126. The biasing member 124 in turn urges the second main swing arm 122 to rotate around the pivot axle 126. Motion of the second main swing arm 122 causes the latch assembly 60 to move from a normally engaged position shown in FIG. 7 to a disengaged position shown in FIG. 9. Explained further, the latch assembly 60 includes outer pins 140 and an inner pin 142. In the normally engaged position (FIG. 7), the outer pins 140 and inner pin 142 are out of alignment with the corresponding first main exhaust rocker arm 20*a* and the second main exhaust rocker arm 20*b*. In this position, the first main exhaust rocker arm 20 and the second main exhaust rocker arm 20*b* rotate together for concurrent motion. When the second main swing arm 122 rotates it causes the outer pins 140 and inner pin 142 to translate into alignment with the first main exhaust rocker arm 20*a* and the second main exhaust rocker arm 20*b* such that only the second main exhaust rocker arm 20*b* rotates while the first main exhaust rocker arm 20*a* does not. A return leaf spring 150 urges the latch assembly 60 to return to the latched position shown in FIG. 9.

Figure 7:
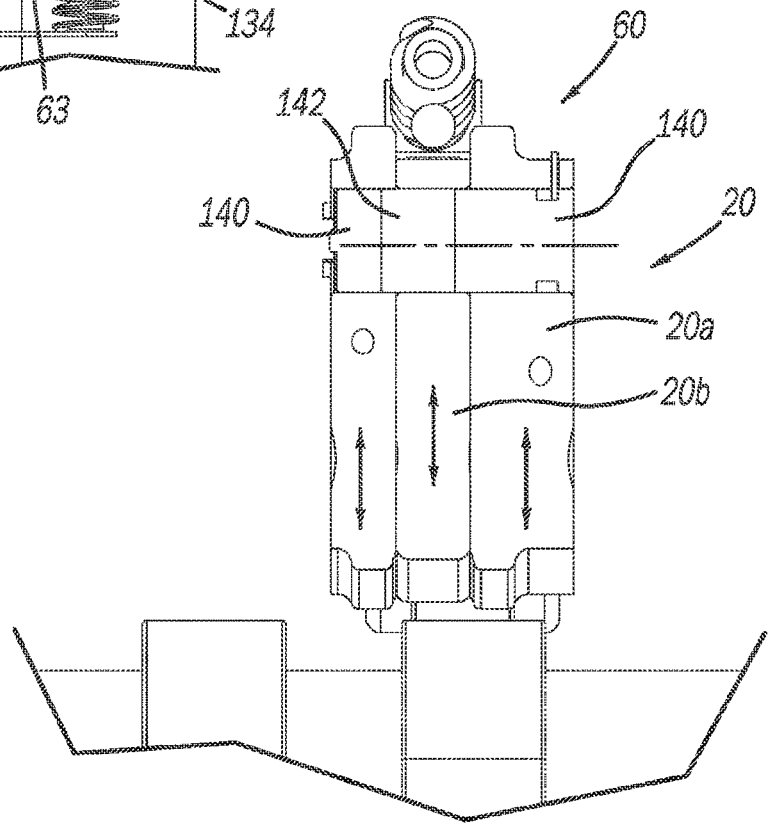
FIG. 7 is a section view of a latch assembly taken along lines 7-7 of FIG. 6 and shown with the latch assembly in a first position.
Figure 8:
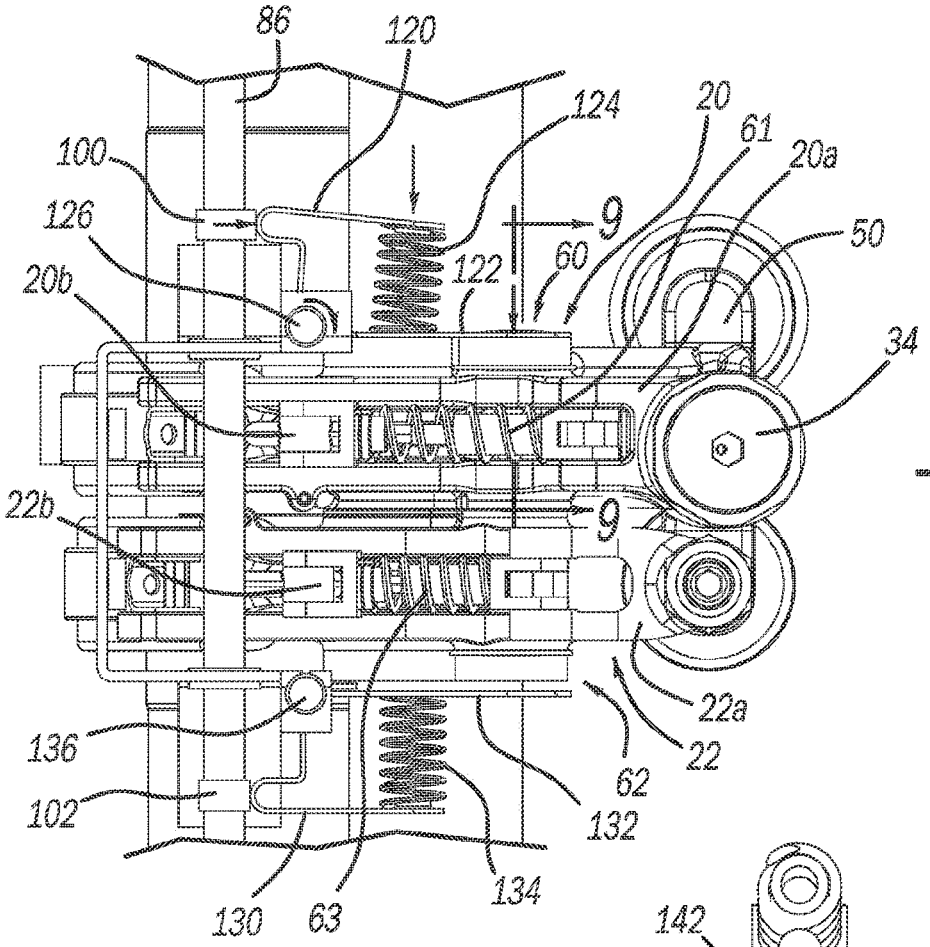
FIG. 8 a plan view of the main and secondary exhaust rocker arm assemblies and exhaust side deactivation assembly of FIG. 5 shown with the main exhaust latch actuation assembly in an activated position.
Figure 9:
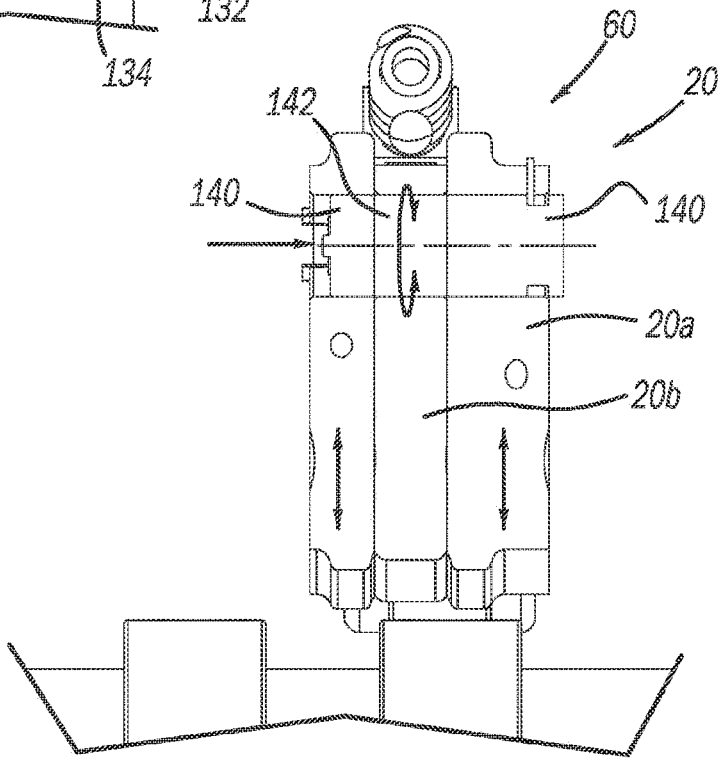
FIG. 9 is a section view of a latch assembly taken along lines 9-9 of FIG. 8 and shown with the latch assembly in a second position.
Figure 10:
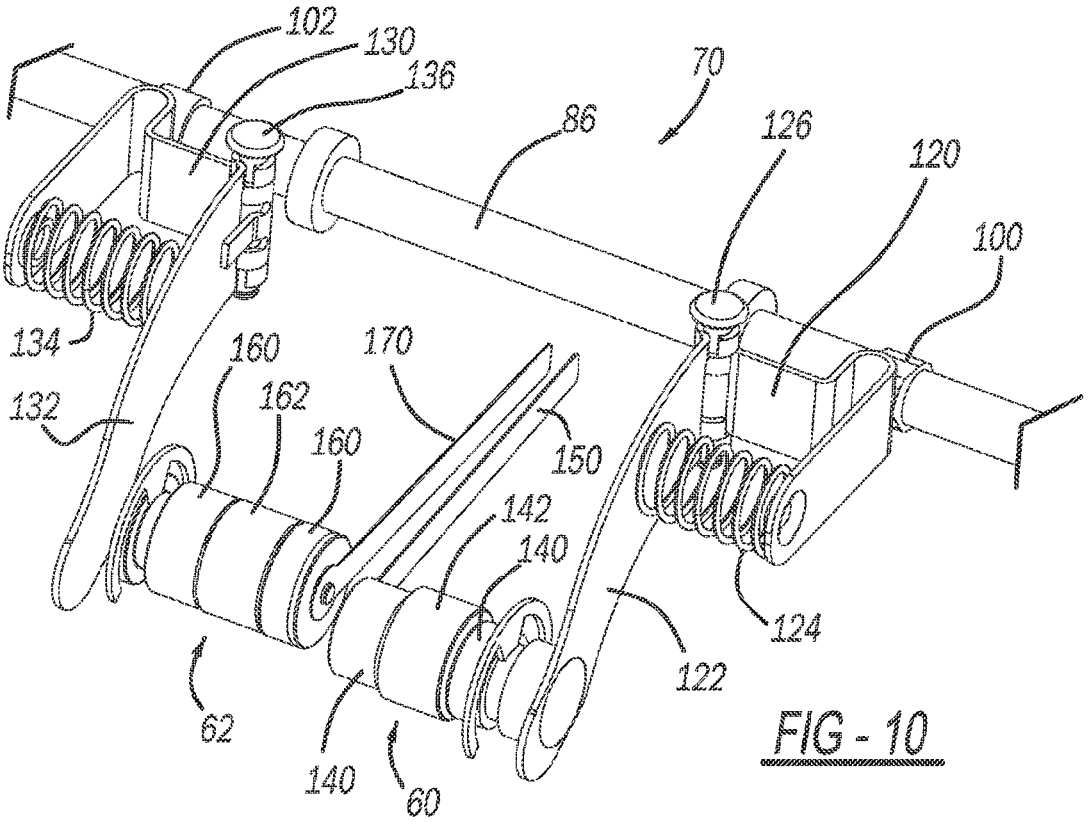
FIG. 10 is a perspective view of the exhaust side deactivation assembly of FIG. 5.
Figure 11:
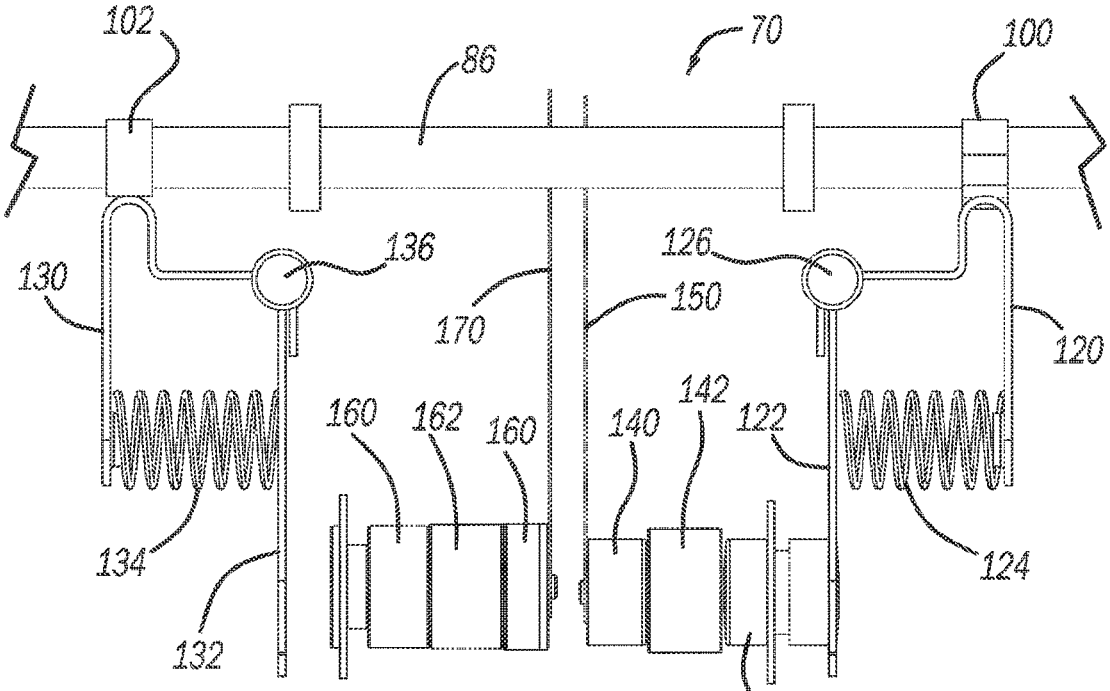
FIG. 11 is a plan view of the exhaust side deactivation assembly of FIG. 10.
Figure 12:
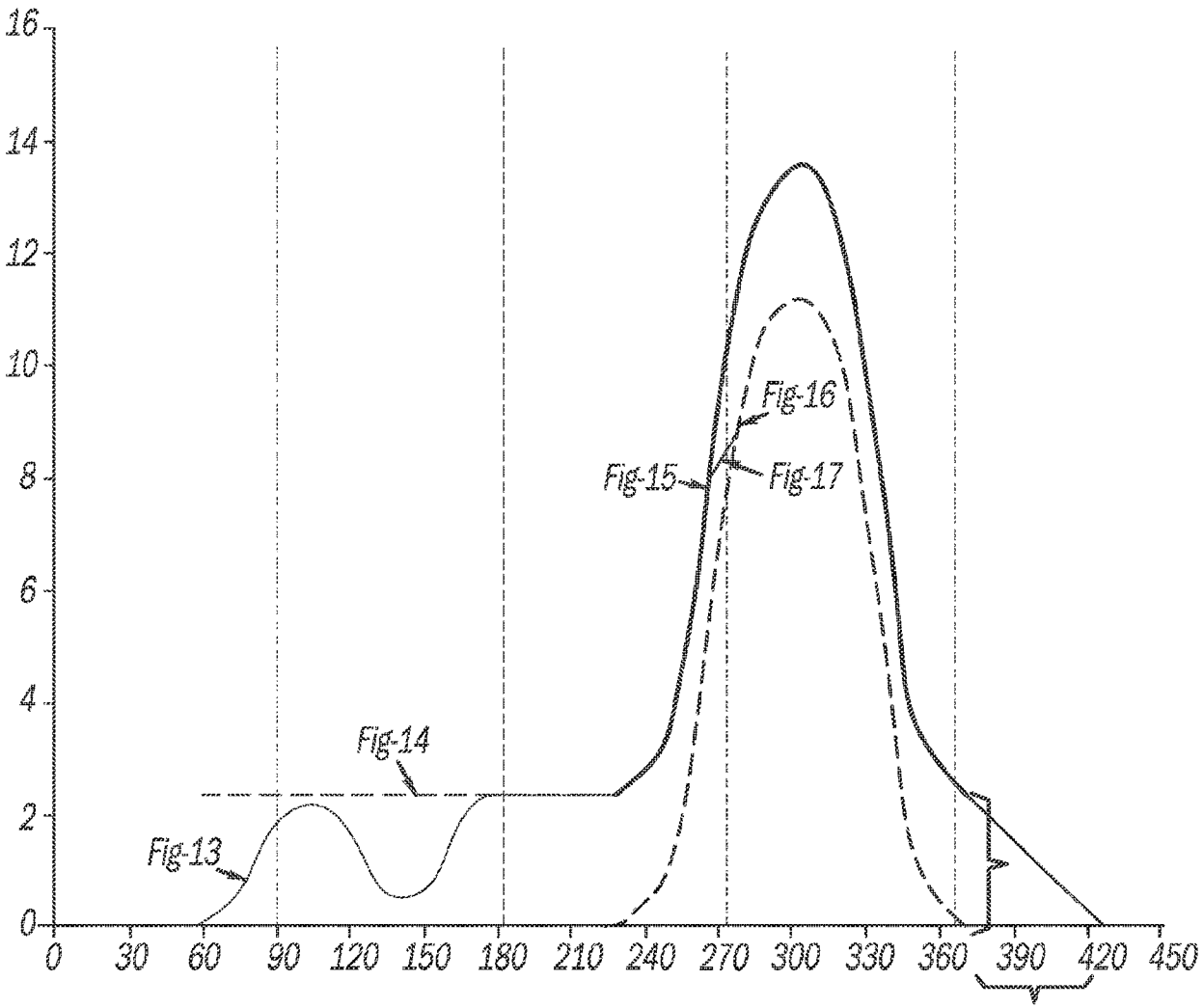
FIG. 12 is a plot showing the reset function in engine brake and drive mode on the main exhaust rocker arm assembly constructed in accordance to the present teachings.
Figure 13:
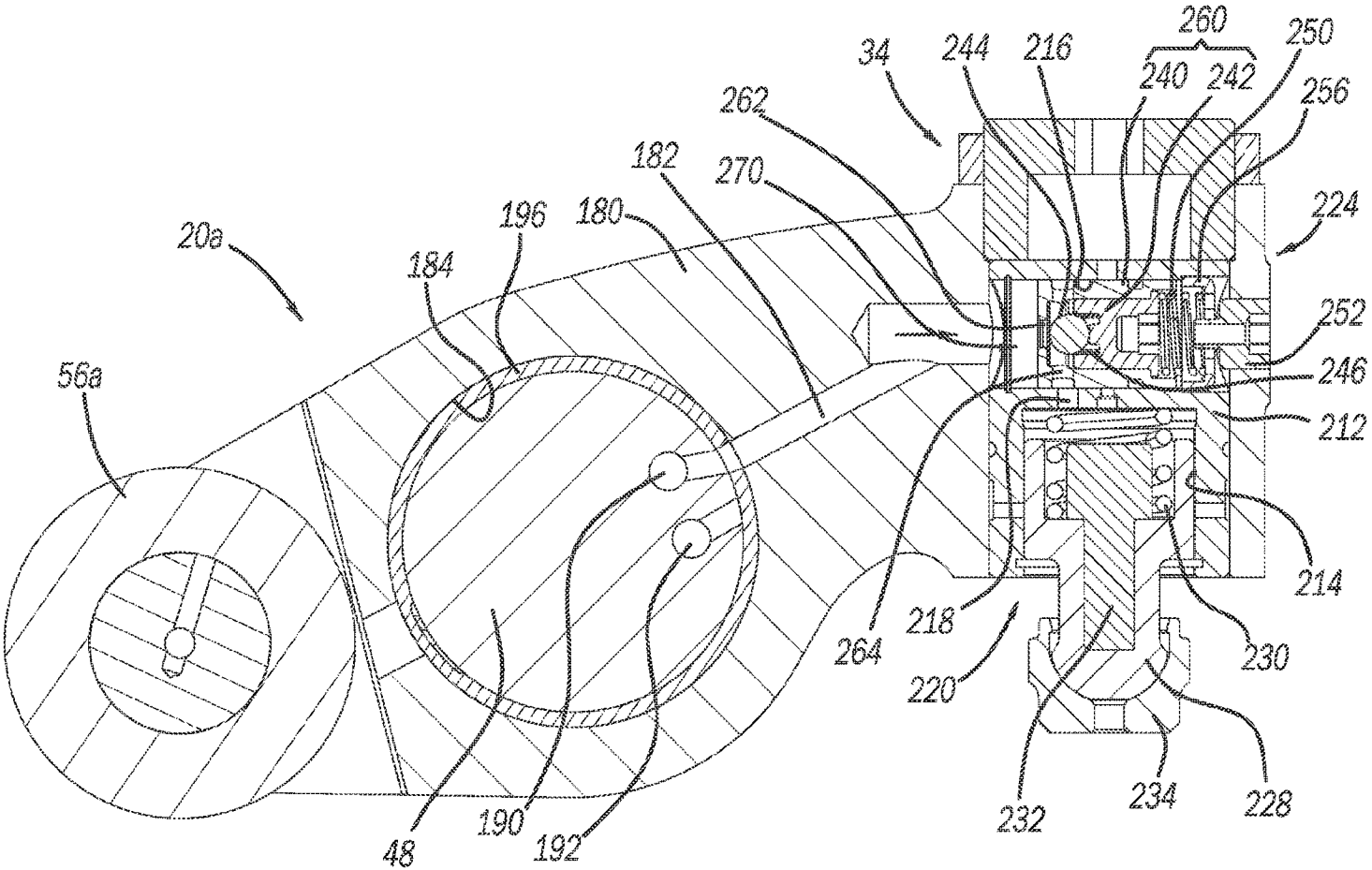
FIG. 13 is a sectional view of a rocker arm assembly constructed in accordance to the present disclosure and shown in engine brake mode.
Figure 14:
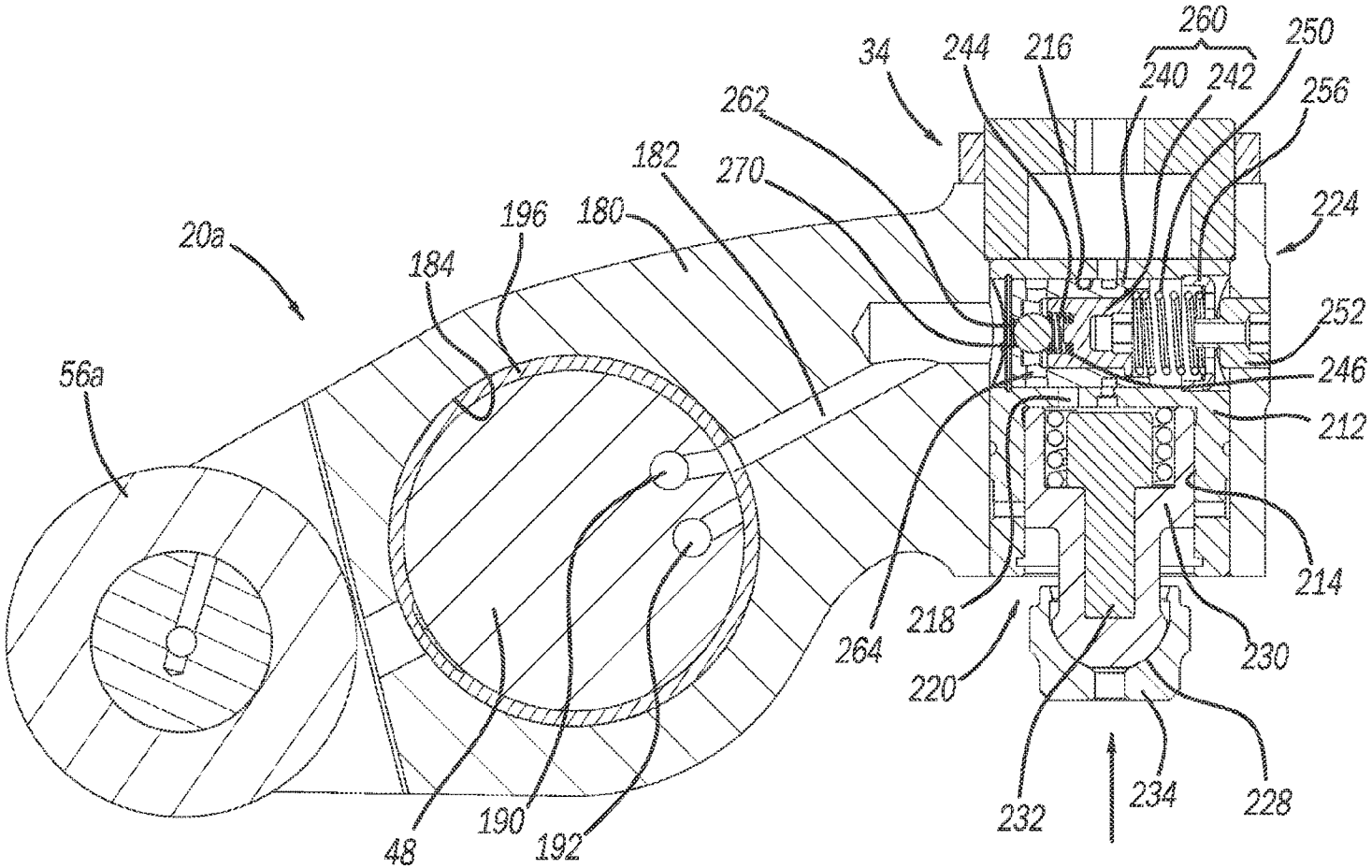
FIG. 14 is a sectional view of a rocker arm assembly constructed in accordance to the present disclosure and shown in drive mode with lost motion.
Figure 15:
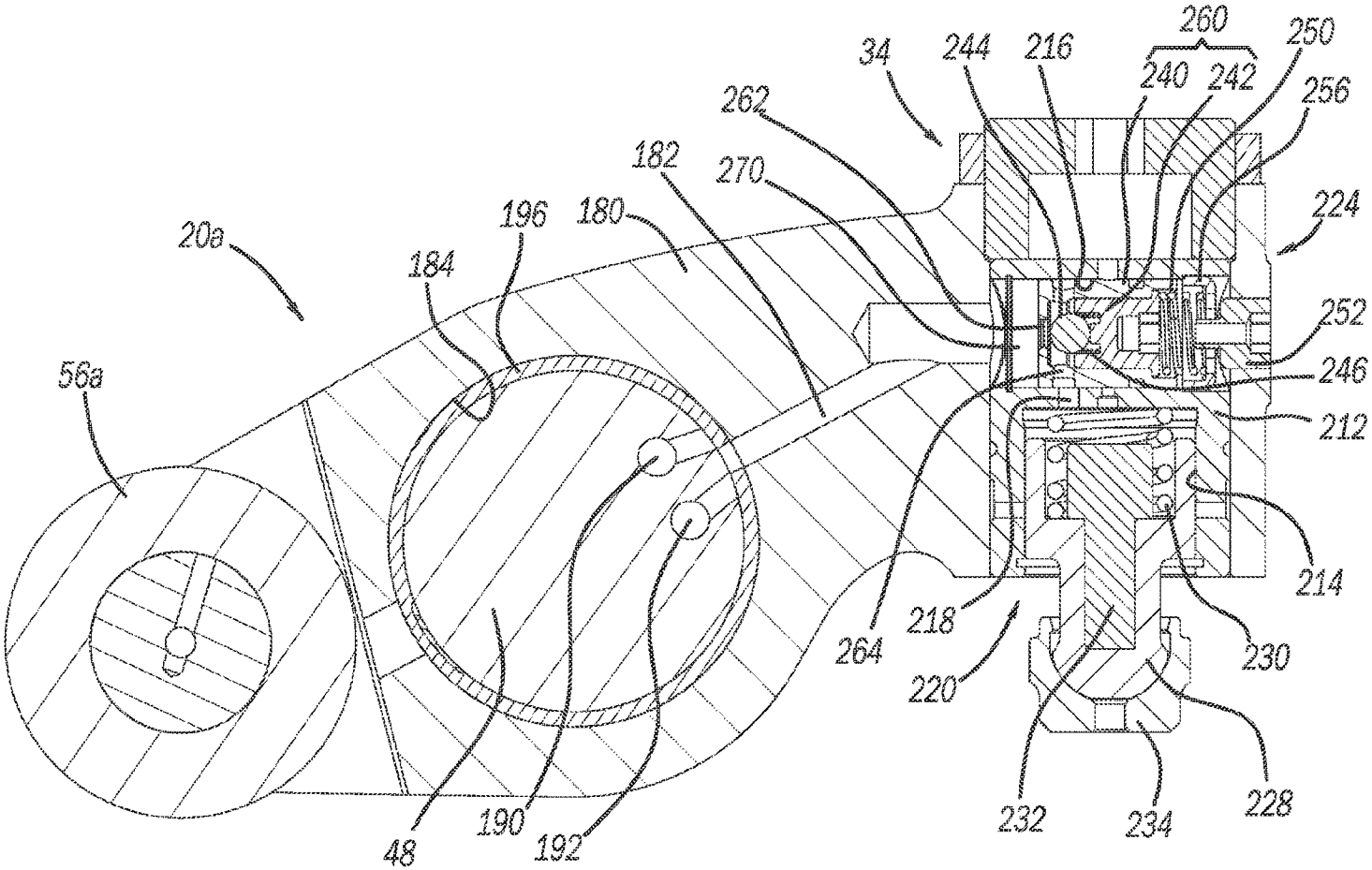
FIG. 15 is a front perspective view of a rocker arm assembly constructed in accordance to the present disclosure and shown with an oil supply channel initially aligned with a reset discharge channel.
Figure 16:
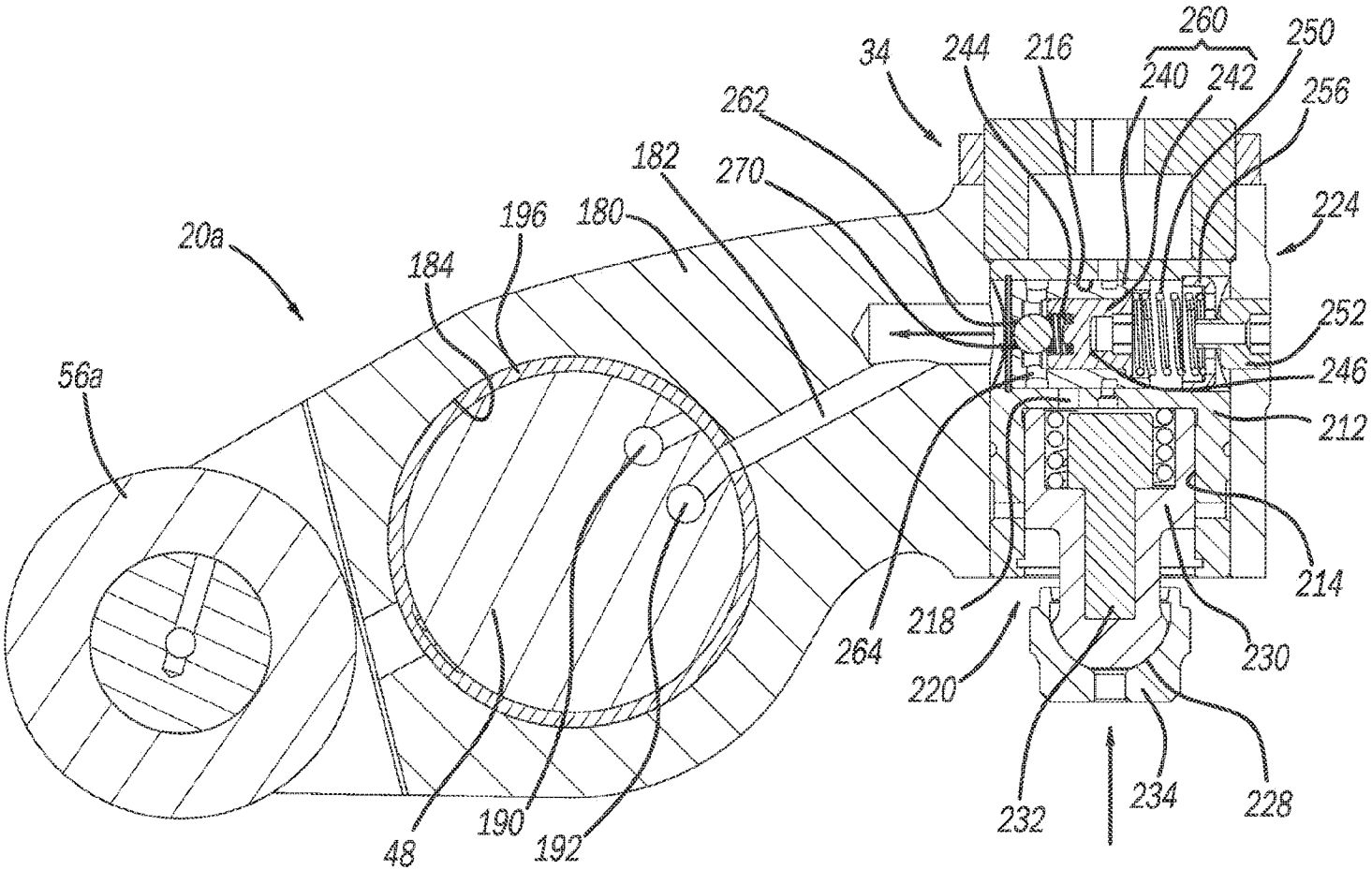
FIG. 16 is a front perspective view of a rocker arm assembly constructed in accordance to the present disclosure and shown upon completion of the reset function.
Figure 17:
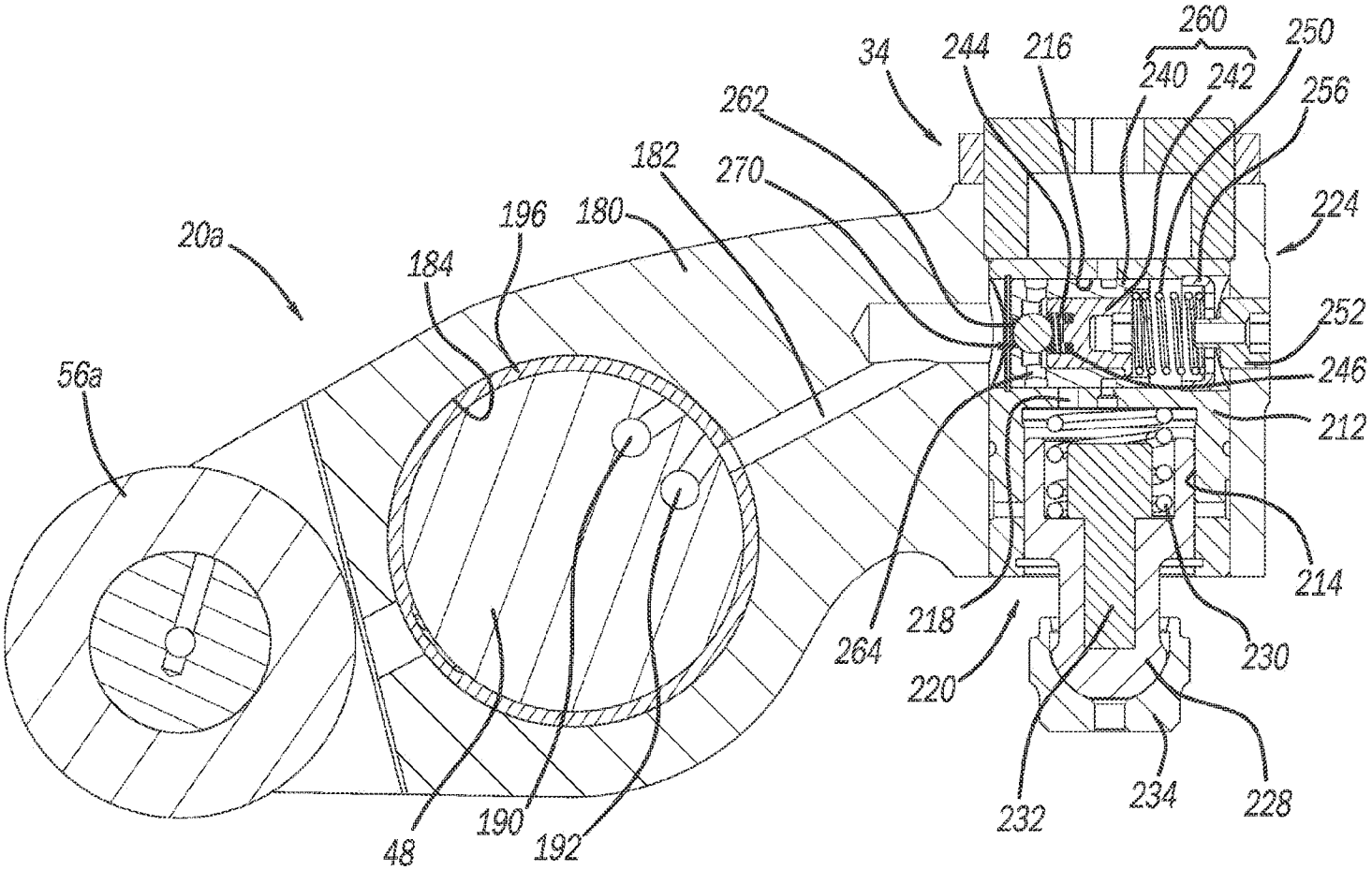
FIG. 17 is a perspective view of a rocker arm assembly constructed in accordance to the present disclosure and shown with the rocker arm assembly further rotated clockwise.

Actuation of the secondary exhaust latch actuation assembly 112 will be described. Rotation of the exhaust side cam rod 86 causes the cam 102 to engage and therefore rotate the first secondary swing arm 130 around the pivot axle 136. The biasing member 134 in turn urges the second secondary swing arm 132 to rotate around the pivot axle 136. Motion of the second secondary swing arm 132 causes the latch assembly 62 to move from a normally engaged position such as shown in FIG. 7 to a disengaged position such as shown in FIG. 9. Explained further, the latch assembly 62 includes outer pins 160 and an inner pin 162. In the normally engaged position (similar to what is shown in FIG. 7), the outer pins 160 and inner pin 162 are out of alignment with the corresponding first secondary exhaust rocker arm 22*a* and the second secondary exhaust rocker arm 22*b*. In this position, the first secondary exhaust rocker arm 22*a* and the second secondary exhaust rocker arm 22*b* rotate together for concurrent motion. When the second secondary swing arm 132 rotates it causes the outer pins 160 and inner pin 162 to translate into alignment with the first secondary exhaust rocker arm 22*a* and the second secondary exhaust rocker arm 22*b* such that only the second secondary exhaust rocker arm 22*b* rotates while the first secondary exhaust rocker arm 22*a* does not. A return leaf spring 170 urges the latch assembly 62 to return to the latched position similar to what is shown in FIG. 9.

Turning now to FIGS. 13-17, the first main exhaust valve rocker arm assembly 20*a* will be described in greater detail. It will be appreciated however that the first main intake valve rocker arm assembly 22*a* is similarly constructed with reset function capabilities. The first main exhaust valve rocker arm assembly 20*a* includes a rocker arm body 180 that defines an oil supply channel 182 and an opening 184 that receives the exhaust rocker shaft 48. As will be explained herein, the oil supply channel 182 is caused to align with an actuation oil supply channel 190 provided on the exhaust rocker shaft 48 along a first operating condition and align with a reset discharge channel 192 along a second operating condition. A bushing 196 can be arranged between the rocker arm body 180 and the exhaust rocker shaft 48.

The first main exhaust valve rocker arm assembly 20*a* can include the capsule assembly 34 that includes a capsule housing 212 received in the rocker arm body 180. The capsule housing 212 defines a plunger chamber 214, a shuttle chamber 216 and a connecting port 218 that connects the plunger chamber 214 and the shuttle chamber 216. The capsule assembly 34 generally includes a plunger assembly 220 and a shuttle assembly 224. The plunger assembly 220 includes a plunger 228, a plunger biasing member 230, a guide rod 232 and an elephant foot 234. The plunger 228 is slidably received in the plunger chamber 214 and biased outwardly by the plunger biasing member 230. As will become appreciated the plunger 228 is caused to be urged outwardly in a rigid position upon accumulation of oil within the plunger chamber 214.

The shuttle assembly 224 can generally include an outer body 240, an inner body 242, a ball 244, a ball biasing member 246, a shuttle biasing member 250, a pin 252 and a cap or closure member 256. The outer and inner body 240 and 242 are collectively referred to herein as a shuttle body 260. The shuttle body 260 can define an upstream shuttle port 262 and a downstream shuttle port 264. The shuttle body 260, ball 244 and ball biasing member 246 can collectively provide a shuttle valve 270 that selectively allows fluid communication in an open position (with the shuttle assembly 224 translated rightward as viewed in the drawings) between the connecting port 218, upstream shuttle port 262 and downstream shuttle port 264.

Turning now to FIGS. 12-17, operation of the first main exhaust rocker arm 20*a* having the reset function in engine brake and drive mode will be described. In drive mode, the shuttle assembly 224 generally occupies a first position (translated leftward as viewed in FIG. 13 biased by the shuttle biasing member 250. In engine brake mode (identified by "FIG. 13" in FIG. 12), the shuttle assembly 224 translates rightward and occupies a second position. In engine brake mode, pressurized oil is communicated through the oil supply channel 182, causing the shuttle assembly 224 to translate rightward and the shuttle valve 270 to open causing oil to fill the plunger chamber 214 and the plunger 228 to move to an extended rigid position.

In drive mode with lost motion (identified by "FIG. 14" in FIG. 7), the shuttle assembly 224 occupies the first position and the plunger chamber 214 is not pressurized. Therefore, the plunger 228 is permitted to translate against the bias of the plunger biasing member 230.

The reset function will now be described. When the first main exhaust rocker arm 20*a* continues rotation around the rocker shaft 48, the oil supply channel 182 will initially align with the reset discharge channel 192 (identified by "FIG. 15" in FIG. 7) causing oil to be drained away from the capsule assembly 210 through the oil supply channel and into the reset discharge channel 192. The shuttle assembly 224 is caused to translate leftward, (identified by "FIG. 17" in FIG. 7), from the bias of the shuttle biasing member 250. The plunger 228 is then free to move to a retracted position (plunger chamber 214 is no longer pressurized). In this regard, the lift profile transitions from the solid line to the dashed line (FIG. 7). Upon completion of the reset function, (identified by "FIG. 16" in FIG. 7), the shuttle assembly 224 remains biased leftward by the shuttle biasing member 250 and the valve lift can follow a standard exhaust lift profile. For rocker arms configured for engine brake and early exhaust valve opening, the oil control valve would be upstream of the capsule assembly 210 controlling oil flow into the capsule assembly 210. For early and late intake valve closing, the oil control valve would be downstream controlling oil flow from the capsule.

Returning now to FIG. 4, various available operating states for the valvetrain 10 are shown. As used herein, the term "activated" corresponds to a respective latch assembly (60, 62, 64, 66) being in the "first" position consistent with concurrent rotation of a corresponding rocker arm pair. Similarly, the term "deactivated" corresponds to a respective latch assembly being in the "second" position consistent with lost motion rotation of the respective second rocker arm relative to the first rocker arm.

For EIVC, the intake oil control valve is OFF for the main intake rocker arm assembly 30; the exhaust oil control valve is ON or OFF for the main exhaust rocker arm assembly 20; the secondary intake rocker arm assembly 32 is deactivated; the secondary exhaust rocker arm assembly 22 is deactivated.

For LIVC, the intake oil control valve for the main intake rocker arm assembly 30 is ON; the exhaust oil control valve is ON or OFF for the main exhaust rocker arm assembly 20; the secondary intake rocker arm assembly 32 is deactivated; the secondary exhaust rocker arm assembly 22 is deactivated.

For standard exhaust lift, the intake oil control valve is ON or OFF for the main intake rocker arm assembly 30; the exhaust oil control valve is OFF for the main exhaust rocker arm assembly 20; the secondary intake rocker arm assembly 32 is deactivated; the secondary exhaust rocker arm assembly 22 is deactivated.

For EEVO, the intake oil control valve is ON or OFF for the main intake rocker arm assembly 30; the exhaust oil control valve is ON for the main exhaust rocker arm assembly 20; the secondary intake rocker arm assembly 32 is deactivated; the secondary exhaust rocker arm assembly 22 is deactivated.

For TSEB, the main intake rocker arm assembly 30 is deactivated; the main exhaust rocker arm assembly 20 is deactivated; the secondary intake rocker arm assembly 32 is activated; the secondary exhaust rocker arm assembly 22 is activated. During cylinder deactivation, all four rocker arm assemblies 20, 22, 30 and 32 are deactivated.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A valvetrain assembly, comprising:

a main exhaust rocker arm assembly having a first main exhaust rocker arm and a second main exhaust rocker arm;

a first latch assembly configured to selectively move between a first position wherein the first and second main exhaust rocker arms are locked for concurrent rotation and a second position wherein one of the first and second main exhaust rocker arms is configured to rotate relative to an other of the first and second main exhaust rocker arms;

a secondary exhaust rocker arm assembly having a first secondary exhaust rocker arm and a second secondary exhaust rocker arm;

a second latch assembly configured to selectively move between a first position wherein the first and second secondary exhaust rocker arms are locked for concurrent rotation and a second position wherein one of the first and second secondary exhaust rocker arms is configured to rotate relative to an other of the first and second secondary exhaust rocker arms; and an actuation assembly configured to selectively move the first and second latch assemblies between the respective first and second positions, the actuation assembly comprising:

an actuator configured to rotate an exhaust cam rod that includes a first cam and a second cam thereon;

a main arm configured to rotate based upon movement of the first cam causing the first latch assembly to move from the respective first position to the respective second position; and a secondary arm configured to rotate based upon movement of the second cam causing the second latch assembly to move from the respective first position to the respective second position.

2. The valvetrain assembly of claim 1, wherein the actuation assembly further comprises a link arm disposed between the actuator and the exhaust cam rod, wherein translation of the link arm causes rotation of the exhaust cam rod.

3. The valvetrain assembly of claim 1, wherein the first latch assembly comprises an inner pin and an outer pin slidably disposed in the main exhaust rocker arm assembly, wherein, when the first latch assembly is in the respective first position, the inner and outer pins are out of alignment with the first and second main exhaust rocker arms, and wherein, when the first latch assembly is in the respective second position, the inner and outer pins are in alignment with the first and second main exhaust rocker arms.

4. The valvetrain assembly of claim 1, wherein the second latch assembly comprises an inner pin and an outer pin slidably disposed in the secondary exhaust rocker arm assembly, wherein, when the second latch assembly is in the respective first position, the inner and outer pins are out of alignment with the first and second secondary exhaust rocker arms, and wherein, when the second latch assembly is in the respective second position, the inner and outer pins are in alignment with the first and second secondary exhaust rocker arms.

5. The valvetrain assembly of claim 1, wherein the main arm comprises a first main swing arm and a second main swing arm that are coupled by a main biasing member, the main biasing member being configured to urge the first main swing arm into engagement with the first cam.

6. The valvetrain assembly of claim 5, further comprising a first leaf spring configured to urge the first latch assembly to return to the respective first position and a second leaf spring configured to urge the second latch assembly to return to the respective first position.

7. The valvetrain assembly of claim 1, wherein the secondary arm comprises a first secondary swing arm and a second secondary swing arm that are coupled by a secondary biasing member, the secondary biasing member being configured to urge the first secondary swing arm into engagement with the second cam.

8. The valvetrain assembly of claim 1, further comprising:

a main intake rocker arm assembly having a first main intake rocker arm and a second main intake rocker arm;

a third latch assembly configured to selectively move between a first position wherein the first and second main intake rocker arms are locked for concurrent rotation and a second position wherein one of the first and second main intake rocker arms is configured to rotate relative to the other of the first and second main intake rocker arms;

a secondary intake rocker arm assembly having a first secondary intake rocker arm and a second secondary intake rocker arm;

a fourth latch assembly configured to selectively move between a first position wherein the first and second secondary intake rocker arms are locked for concurrent rotation and a second position wherein one of the first and second secondary intake rocker arms rotates relative to the other of the first and second secondary intake rocker arms, wherein the actuation assembly further comprises an intake cam rod, and wherein the actuator is configured to concurrently rotate the exhaust and intake cam rods.

9. The valvetrain assembly of claim 8, wherein the main exhaust rocker arm assembly is configured to selectively operate in standard exhaust lift and early exhaust valve opening (EEVO), and the main intake rocker arm assembly is configured to selectively operate in early intake valve closing (EIVC) and late intake valve closing (LIVC).

10. The valvetrain assembly of claim 9, wherein the secondary exhaust rocker arm assembly and the secondary intake rocker arm assembly are configured to selectively operate in two-stroke engine brake (TSEB).

11. The valvetrain assembly of claim 1, wherein the first main exhaust rocker arm has a rocker arm body that defines an oil supply channel and an opening that receives an exhaust rocker shaft of the first main exhaust rocker arm.

12. The valvetrain assembly of claim 11, wherein the first main exhaust rocker arm further comprises:

a first capsule assembly disposed on the rocker arm body and configured to selectively communicate oil to and from the oil supply channel, the first capsule assembly comprising:

a plunger assembly having a plunger configured to selectively translate within a plunger chamber between an extended rigid position based upon the plunger chamber being pressurized with oil and a retracted, non-rigid position based upon the plunger chamber being depressurized, the plunger being configured to move an engine valve toward an open position; and a shuttle assembly configured to move between a first position and a second position based upon oil communicated in the oil supply channel, the shuttle assembly having a shuttle valve configured to selectively move between a closed position and an open position wherein in the open position oil flows into the plunger chamber, wherein the main exhaust rocker arm assembly is configured to sequentially move along (i) a first valve lift profile wherein pressurized oil is communicated from the oil supply channel, the shuttle assembly being configured to move into the respective second position to cause the shuttle valve to be opened, the plunger chamber to be pressurized, and the plunger to move to the extended rigid position, (ii) a reset valve lift profile wherein pressurized oil is not communicated from the oil supply channel, the shuttle assembly moving into the respective first position, and (iii) a valve closing profile.

13. The valvetrain assembly of claim 12, wherein the shuttle assembly is configured to move into the respective second position based on the oil supply channel of the rocker arm body being aligned with an actuation oil supply channel on the exhaust rocker shaft of the first main exhaust rocker arm.

14. The valvetrain assembly of claim 12, wherein the shuttle assembly is configured to move into the respective first position based on the oil supply channel of the rocker arm body being aligned with a reset discharge channel on the exhaust rocker shaft of the first main exhaust rocker arm.

15. The valvetrain assembly of claim 1, wherein the actuator comprises a pneumatic actuator.

16. A valvetrain assembly, comprising:

a main exhaust rocker arm assembly having a first main exhaust rocker arm and a second main exhaust rocker arm;

a secondary exhaust rocker arm assembly having a first secondary exhaust rocker arm and a second secondary exhaust rocker arm;

a main intake rocker arm assembly having a first main intake rocker arm and a second main intake rocker arm;

a secondary intake rocker arm assembly having a first secondary intake rocker arm and a second secondary intake rocker arm; and an actuation assembly configured to selectively lock and unlock (i) the first and second main exhaust rocker arms, (ii) the first and second secondary exhaust arms, (iii) the first and second main intake rocker arms, and (iv) the first and second secondary intake rocker arms, the actuation assembly having an actuator configured to translate a link arm to cause concurrent rotation of an exhaust cam rod and an intake cam rod.

17. The valvetrain assembly of claim 16, further comprising:

a first latch assembly configured to selectively move between a first position wherein the first and second main exhaust rocker arms are locked for concurrent rotation and a second position wherein one of the first and second main exhaust rocker arms is configured to rotate relative to an other of the first and second main exhaust rocker arms;

a second latch assembly configured to selectively move between a first position wherein the first and second secondary exhaust rocker arms are locked for concurrent rotation and a second position wherein one of the first and second secondary exhaust rocker arms is configured to rotate relative to an other of the first and second secondary exhaust rocker arms;

a third latch assembly configured to selectively move between a first position wherein the first and second main intake rocker arms are locked for concurrent rotation and a second position wherein one of the first and second main intake rocker arms is configured to rotate relative to an other of the first and second main intake rocker arms; and a fourth latch assembly configured to selectively move between a first position wherein the first and second secondary intake rocker arms are locked for concurrent rotation and a second position wherein one of the first and second secondary intake rocker arms is configured to rotate relative to an other of the first and second secondary intake rocker arms.

18. The valvetrain assembly of claim 17, wherein the first latch assembly comprises an inner pin and an outer pin slidably disposed in the main exhaust rocker arm assembly, wherein, when the first latch assembly is in the respective first position, the inner and outer pins are out of alignment with the first and second main exhaust rocker arms, and wherein, when the first latch assembly is in the respective second position, the inner and outer pins are in alignment with the first and second main exhaust rocker arms.

19. The valvetrain assembly of claim 17, wherein the second latch assembly comprises an inner pin and an outer pin slidably disposed in the secondary exhaust rocker arm assembly, wherein, when the second latch assembly is in the respective first position, the inner and outer pins are out of alignment with the first and second secondary exhaust rocker arms, and wherein, when the second latch assembly is in the respective second position, the inner and outer pins are in alignment with the first and second secondary exhaust rocker arms.

20. The valvetrain assembly of claim 16, wherein the main exhaust rocker arm assembly is configured to selectively operate in standard exhaust lift and early exhaust valve opening (EEVO) and the main intake rocker arm assembly is configured to selectively operate in early intake valve closing (EIVC) and late intake valve closing (LIVC), and wherein the secondary exhaust rocker arm assembly and the secondary intake rocker arm assembly are configured to selectively operate in two-stroke engine brake (TSEB).

* * * * *